US005533529A

United States Patent [19]

Ohno

[11] Patent Number: 5,533,529

[45] Date of Patent: Jul. 9, 1996

[54] METHOD AND DEVICE FOR ARTIFICIALLY INCREASING HAIR

[76] Inventor: Kunio Ohno, 8-5, Senju-tatsuta-cho, Adachi-ku, Tokyo, Japan

[21] Appl. No.: 356,963

[22] Filed: Dec. 16, 1994

[30] Foreign Application Priority Data

Dec. 17, 1993 [JP] Japan ..... 5-353082

[51] Int. Cl.[6] ..... A45D 24/00

[52] U.S. Cl. ..... 132/200; 132/201

[58] Field of Search ..... 289/3, 17; 132/201, 132/207, 56, 333

[56] References Cited

U.S. PATENT DOCUMENTS

| | | | |
|---|---|---|---|
| 2,859,994 | 11/1958 | Whitlinger | 289/17 |
| 3,101,964 | 8/1963 | Reaser | 289/17 |
| 3,727,619 | 4/1973 | Kuris | 132/56 |
| 3,960,158 | 6/1976 | Simmons | 132/56 |
| 4,372,330 | 2/1983 | Nelson . | |
| 4,982,748 | 1/1991 | Trimarchi . | |

FOREIGN PATENT DOCUMENTS

| | | |
|---|---|---|
| 0438986 | 7/1991 | European Pat. Off. . |
| 5-156506 | 6/1993 | Japan . |
| 1505263 | 3/1978 | United Kingdom . |

*Primary Examiner*—Nicholas D. Lucchesi
*Assistant Examiner*—Pedro Philogene
*Attorney, Agent, or Firm*—Wenderoth, Lind & Ponack

[57] ABSTRACT

Hair on the head is increased by tying artificial or false hairs to natural hairs by use of a guide rod including a slide pin with a retractable catch member in such a manner that a false hair is first wound around the guide rod to form a preliminary knot around the guide rod. The preliminary knot is transferred to the natural hair while holding the natural hair with the catch member and further is moved to a prescribed position of the natural hair. The preliminary knot then is tightened. Thus, the false hairs can be steadily fastened to the natural hairs to effectively increase the hair on the head.

5 Claims, 7 Drawing Sheets

METHOD AND DEVICE FOR ARTIFICIALLY INCREASING HAIR

BACKGROUND OF THE INVENTION

1. Field of the Invention

This invention relates to a method for artificially increasing hair by tying natural or false hairs to natural hairs on the human head or artificial hairs of a wig, hairpiece or the like, and a device for use in practicing such hair-increasing method.

2. Description of the Prior Art

Not infrequently, one who has a thin growth of hair has worn an artificial head of hair, such as a wig. Recently, there has been proposed a hair-increasing method in which human hairs or artificial hairs are tied to natural hairs growing on the human head to artificially increase the amount of hair thereon by two or three times. (The artificial hairs, which includes separate human hairs and so-called pseudo-hairs, to be artificially fastened to the natural hairs on the head are generically referred as to "false hair" hereinafter.) This hair-increasing method has an advantage in that since the natural hair growing on the head is used, the increased hair can be groomed into a natural hairstyle. However, a skilled manner of effectively securing the false hairs to the natural hairs growing on the head has not been established.

Such a conventional hair-increasing method as mentioned above is carried out by tying one or more false hairs to the natural hair on the human head. However, the hair-tying operation is difficult because both the natural hair and false hair are very thin, pliable and slippery. That is, since a great number of false hairs must be secured on the head in order to form a natural hairstyle, the tying operation often is much harder and more time-consuming than might be expected.

The false hairs are generally tied one by one to the natural hairs on the head by hand. The operation of fastening the false hair to the natural hair on the head is ordinarily done by bringing the false hair near the natural hair with an implement, loosely knotting the false hair around the natural hair with fingers, moving the knot in the false hair toward the hair root, and tightening the knot. However, the operation of tying the false hair to the natural hair by a manual operation demands much skill.

Japanese Patent Public Disclosure No. HEI 5-156506(A) discloses one example of conventional hair-increasing methods in which a natural hair is tied into a knot and a false hair is tied between the knot in the natural hair and the scalp. More specifically, the false hair is fastened to the natural hair by the steps of bending the false hair into a substantially U-shape having a U-shaped bent portion and two free end portions, passing the free end portions of the bent false hair through the bent portion to form a first loop in the bent false hair, winding the free end portions around the natural hair between the knot in the natural hair and the scalp, passing the free end portions through the first loop to form a second loop through which the natural hair is allowed to pass, and pulling the free end portions to tighten the bent false hair around the natural hair.

This conventional hair-increasing method has to use a cylindrical hair guide member with an inner passage for permitting a natural hair growing on the human head to pass therethrough. Prior to letting the natural hair through the inner passage of the cylindrical member, the false hairs are wound around the cylindrical member in advance in such a state that the cylindrical member is placed in the aforesaid second loop of the false hair. Upon insertion of the natural hair into the inner passage of the cylindrical member, the false hair wound around the cylindrical member is slid down to be wound directly around the natural hair near the scalp, and thereafter, tightened and thus secured in position.

As described above, the conventional hair-increasing method necessitates the preparation of winding the false hairs around the cylindrical member in advance and a lot of skill in holding the cylindrical member in position near the scalp and letting the false hair off the cylindrical member. Thus, the work of tying the false hair to the natural hair according to this conventional method requires much time and labor and proves to be troublesome.

Furthermore, the fixation of the false hair to the natural hair on the head is established merely by substantially two linear parts of the false hair bent in a U-shape. Therefore, no matter how tight the false hair is tied to the natural hair, the false hair tied to the natural hair easily comes off when the hair is roughly washed or combed.

Thus, there has been a great need for a hair-increasing method capable of efficiently and securely tying false hairs to the natural hairs on the head with a simple operation.

OBJECT OF THE INVENTION

This invention is made to eliminate the drawbacks suffered by the conventional hair-increasing method as described above and has an object to provide a hair-increasing method capable of steadily fastening false hairs to the natural hairs or hairs of the human head or to artificial hairs of a wig with ease and with a high efficiency so as not to permit the false hairs fastened to the natural or artificial hairs to easily come off even if the increased hair is roughly washed or combed.

Another object of this invention is to provide a simple and convenient device capable of permitting false hairs to be steadily fastened to the natural hairs on the human head or artificial hairs of a wig with ease to effectively increase the hair.

SUMMARY OF THE INVENTION

To attain the object described above according to this invention, there is provided a hair-increasing method which comprises winding a false hair around a guide rod having a slide pin to form a preliminary knot around the guide rod, holding the natural hair with the slide pin, transferring the preliminary knot from the guide rod to a desired position of the natural hair, and pulling both the false hair and natural hair to tighten the knot in the false hair.

One or more false hairs may be fastened to each natural hair. In either event, the false hair is first bent into two so as to have a U-shaped bent portion, and linear loop-forming portions arranged side by side. Next, the loop-forming portions of the bent false hair are wound at least one time around the guide rod so as to form a loop of the bent portion around the guide rod. Then, the looped bent portion is slipped on the tip end of the guide rod over the loop-forming portions wound around the guide rod to form a preliminary knot around the guide rod. Thereafter, the preliminary knot is moved on the natural hair on the human head and tightened. The tight knot around the natural hair cannot easily be slipped off because the false hair having-the looped bent portion and loop-forming portions wound around the natural hair is intricately twined around the natural hair.

The present invention further provides a device for use in practicing the aforementioned hair-increasing method. Such device includes a hollow guide rod having a tip end, a slide pin inserted in the hollow guide rod in a slidable state and provided at its leading end with a catch member, and a spring for urging the slide pin rearwardly, i.e. for retracting the slide pin into the guide rod. By pushing the rear end of the slide pin against the spring, the catch member of the slide pin is protruded from the tip end of the guide rod so as to hold the natural hair on the head. Then, by releasing the slide pin, the catch member is retracted while holding the natural hair. The knot loosely formed around the natural hair can be made tight merely by pulling the false hair with the natural hair still held by the guide rod.

The catch member retractable into the guide rod may be formed as a hook or by a pair of pincers which open in a protruded state and close in a retracted state.

The hair-increasing method of this invention is applicable not only for natural hairs of the human head, but also artificial hairs of a wig and so forth. As the false hair to be fastened to the natural or artificial hair, an artificial hair made of synthetic fiber or natural yarn or fiber such as a separate natural hair may be used.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

Figure 1:
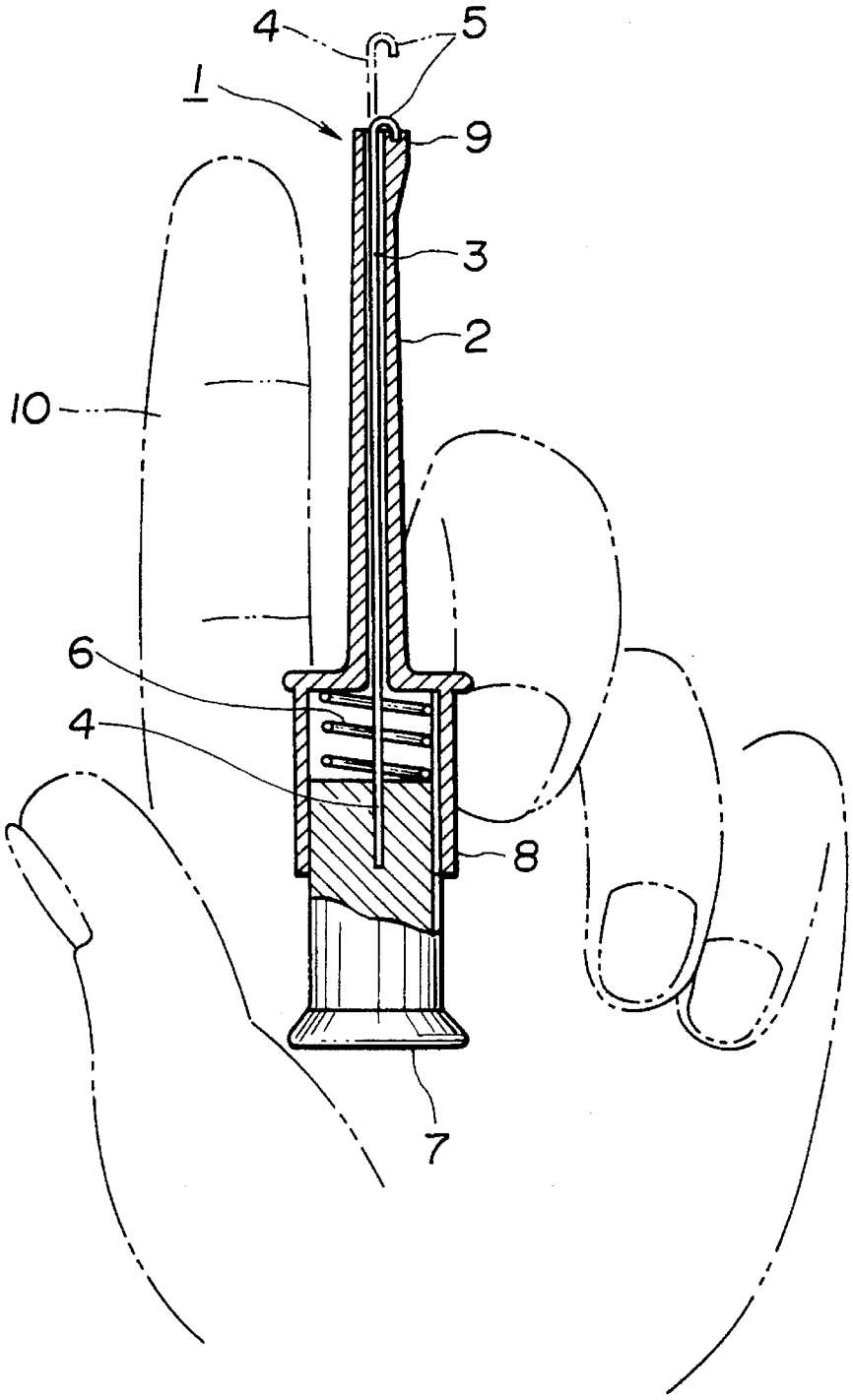
FIG. 1 is a front view, partially in section, of a hair-increasing device according to this invention.

The present invention will be more fully understood from the detailed description given hereinbelow and the accompanying drawings which are given by way of illustration only, and thus are not limitative of the present invention.

One preferred embodiment of the hair-increasing method and device of this invention will be described with reference to the accompanying drawings. According to the method and device, an artificial hair, herein called "false hair", such as a synthetic fiber hair and separate human hair, can be steadily tied to the natural hair on the human head to artificially increase hair.

In the drawings, reference numeral 1 denotes a hair-increasing device of this invention, which comprises a hollow guide rod 2 with an axial through hole 3, a slide pin 4 slidably inserted in the through hole 3 and provided at its leading end with a catch member 5, a coil spring 6 for urging the slide pin 4 rearward in a normal state, and a push member 7 connected to the rear end of the slide pin 4.

The guide rod 2 is made of, for example, a plastic cylinder and is integrally formed at its rear end with a grip 8 in which the coil spring 6 is set between the rear end of the guide rod 2 and the push member 7 so as to urge the push member 7 and slide pin 4 rearward.

The slide pin 4 may be made of a wire- or bar-shaped steel or other rigid material. In this embodiment, the catch member 5 is formed like a hook by bending the leading end of the slide pin 4 in a substantially U-shape. The catch member 5 is retracted into the guide rod 2 by means of the coil spring 6 in a normal state, and emerges out of the guide rod 2 when pushing the push member 7. Thus, by utilizing such a function of the catch member 5 capable of protruding from the guide rod 2, the natural hair growing on the human head is caught and securely held by the catch member 5 when tying a false hair to the natural hair on the head.

In this embodiment, the guide rod 2 is provided in its leading end with a depression for completely receiving the U-shaped catch member 5 so as to firmly hold the natural hair.

Next, the procedure of steadily tying the false hair to the natural hair according to the hair-increasing method of this invention by use of the device as described above will be described in detail with reference to FIG. 2 through FIG. 7.

Figure 2:
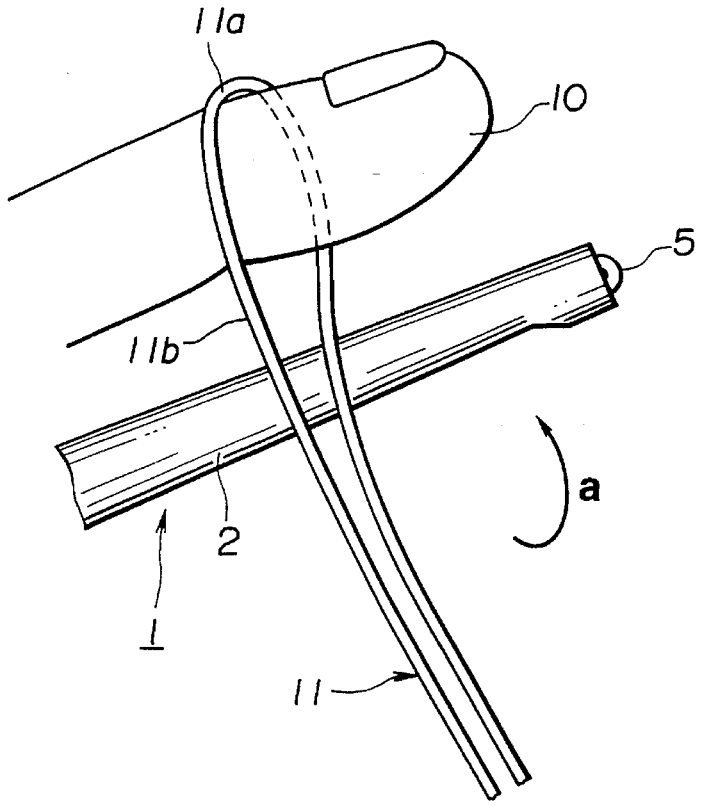
FIG. 2 is an explanatory view showing a first step in the procedure for practicing the hair-increasing method of this invention, in which a false hair is bent into a U-shape with a finger.
Figure 3:
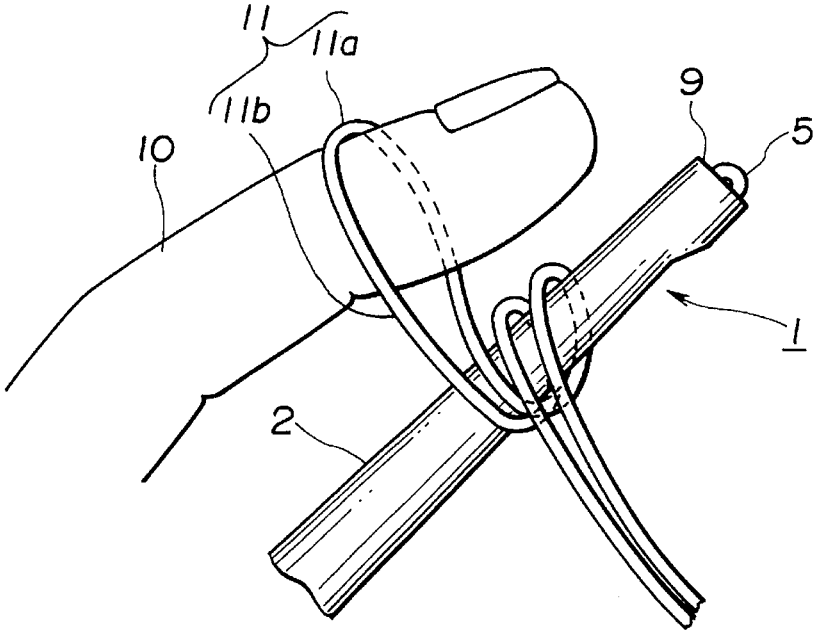
FIG. 3 is an explanatory view showing a second step of the hair-increasing method of this invention, in which the bent false hair is wound around the device of FIG. 1.
Figure 4:
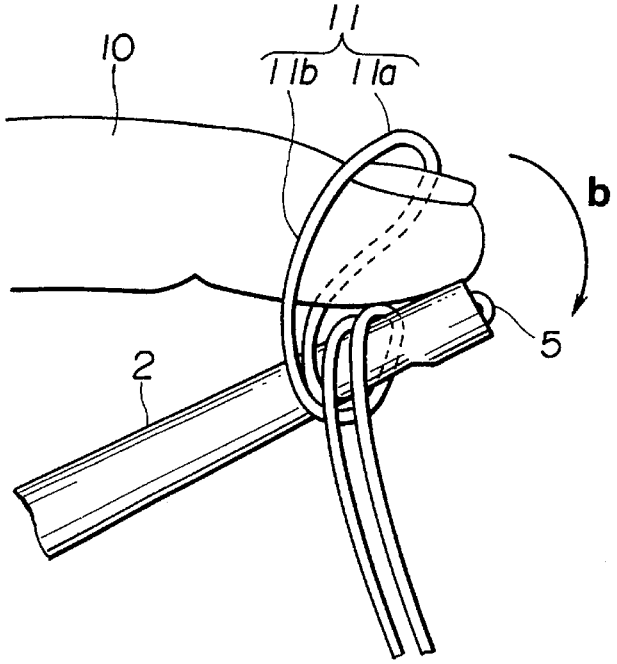
FIG. 4 is an explanatory view showing a third step of the hair-increasing method of this invention, in which the loop of the bent false hair is brought near to the tip end of the hair-increasing device.
Figure 5:
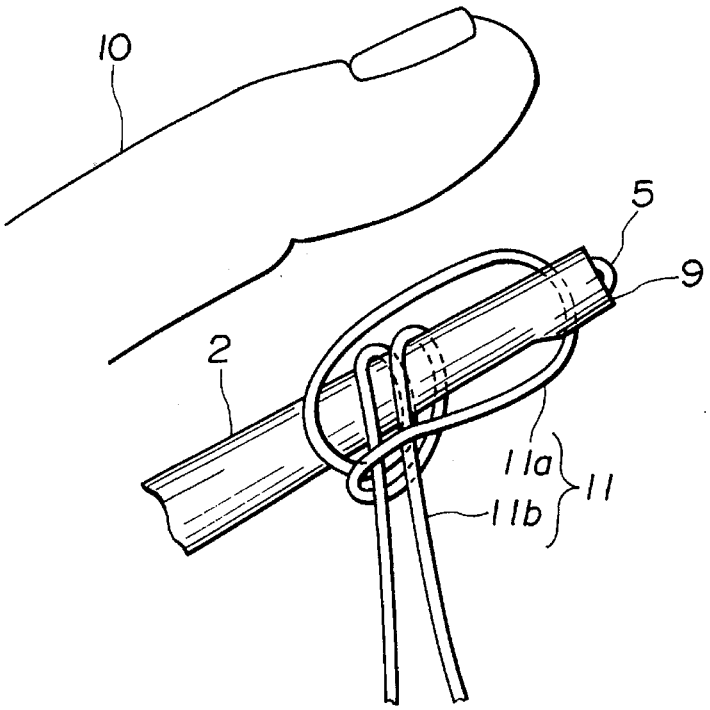
FIG. 5 is an explanatory view showing a forth step of the hair-increasing method of this invention, in which the loop of the bent false hair is slipped on the tip end of the hear-increasing device to form a preliminary knot.
Figure 6:
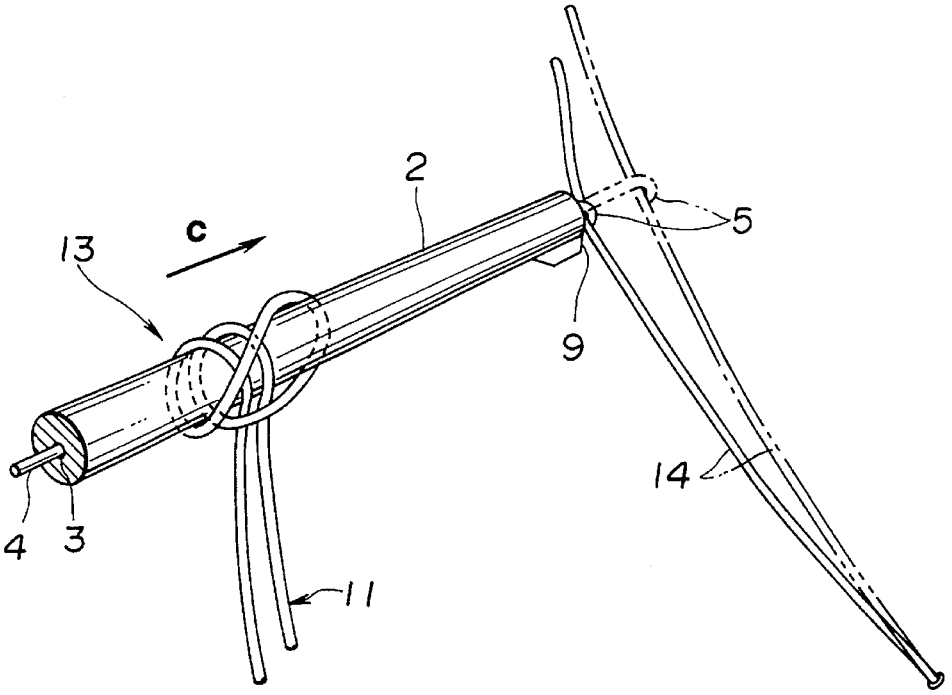
FIG. 6 is an explanatory view showing a fifth step of the hair-increasing method of this invention, in which the preliminary knot around the hair-increasing device is transferred to a natural hair on the head.
Figure 7:
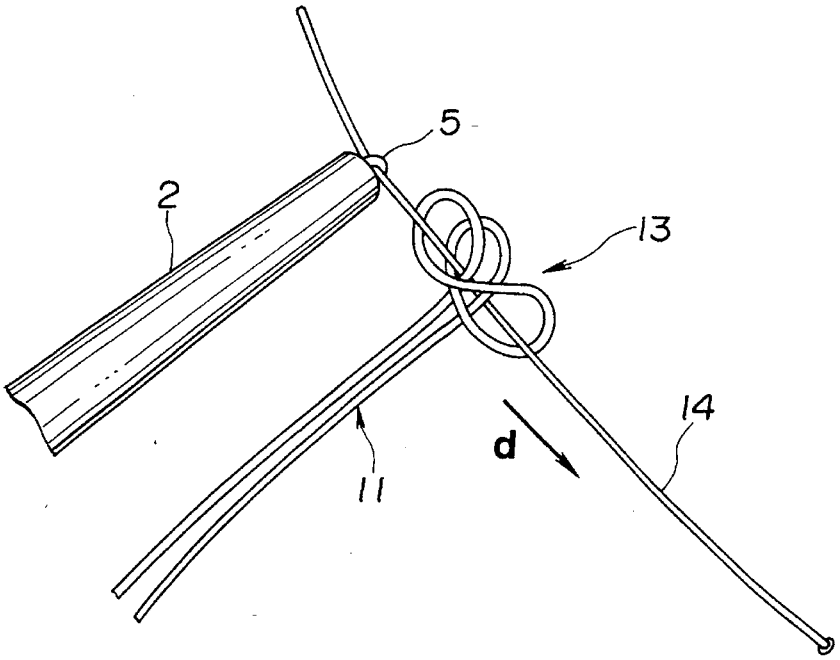
FIG. 7 is an explanatory view showing a sixth step of the hair-increasing method of this invention, in which the preliminary knot around the natural hair is moved to a prescribed position near the hair root.

The hair-increasing device 1 is first held by hand while stretching a finger 10 in parallel with the guide rod 2 as illustrated in FIG. 1. Then, the false hair 11 is doubled around finger 10 as shown in FIG. 2, thereby to have a middle portion of false hair 11 bent in a substantially U-shape (bent portion 11*a*), linear loop-forming portions 11*b* arranged side by side, with end portions thereof aligned or trued up. Next, the loop-forming portions 11*b* of the doubled false hair 11 are wound around the guide rod 2 toward the tip end 9 thereof as indicated by the arrow a in FIG. 2, so as to form a loop of the bent portion 11*a* at a distance somewhat spaced from the tip end 9 of the guide rod 2 across the loop-forming portions 11*b* wound around the guide rod as shown in FIG. 3. Then, as shown in FIGS. 4 and 5, the looped bent portion 11*a* of the false hair 11 is slipped on the tip end 9 of the guide rod 2 over the loop-forming portions 11*b* wound around the guide rod 2 as indicated by the arrow b in FIG. 4. Thus, a loosely tied preliminary knot 13 is formed around the guide rod 2 as illustrated in FIG. 5. Next, the slide pin 4 is pushed by operating the push member 7 against the spring 6 to protrude the catch member 5 out of the tip end 9 of the guide rod 2, and then, a natural hair 14 growing on the human head is caught by the catch member 5 and securely held by retracting the catch member 5 as shown in FIG. 6. Thereafter, the preliminary knot 13 is slid, as indicated by the arrow c in FIG. 6, to be transferred to the natural hair 14 over the tip end 5 of the guide rod 2. At this time, the free end of the natural hair 14 is also passed through the preliminary knot 13. The preliminary knot 13 supported by the natural hair 14 is further moved along the natural hair 14 to a prescribed position near the hair root as indicated by the arrow d in FIG. 7. When the loosely tied preliminary knot 13 arrives at the prescribed position of the natural hair 14, the preliminary knot 13 is tightened hard. By this time, the natural hair 14 may be still held by the guide rod 2 to facilitate the tying of the false hair 11 to the natural hair 14.

Figure 8:
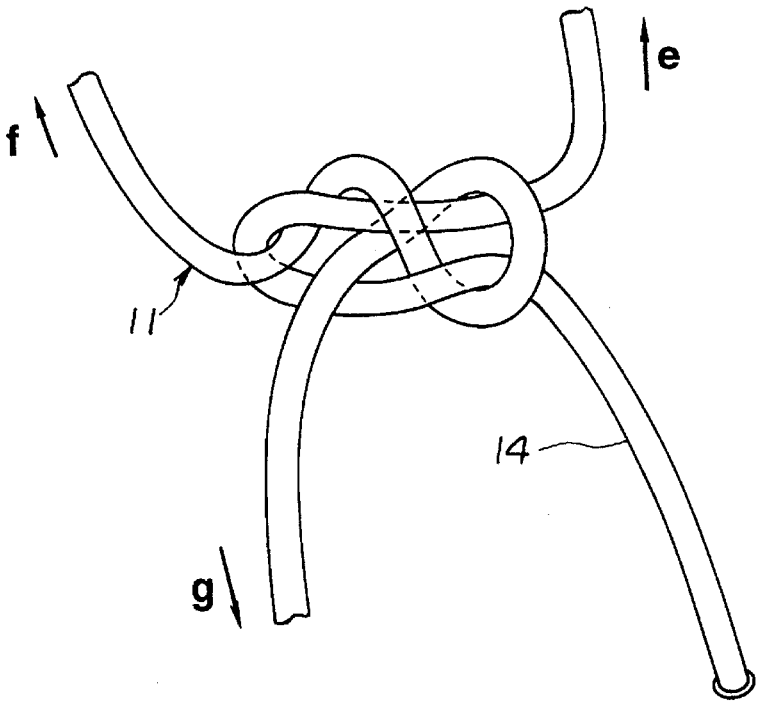
FIG. 8 is an enlarged view explanatory of the knot formed around the natural hair.

Consequently, the false hair 11 is inextricably fixed to the natural hair 14 because the knot is made by windings of three turns of the false hair 11 in such a state that the false hair 11 is intricately wound around the natural hair as illustrated in FIG. 8. The false hair knotted in its loose state as shown in FIG. 8 may be tightened up by pulling both ends of the false hair 11 in opposite directions (arrows f and g) while pulling the natural hair 14 in the direction of the arrow e by using the aforementioned hair-increasing device 1.

Figure 9A:
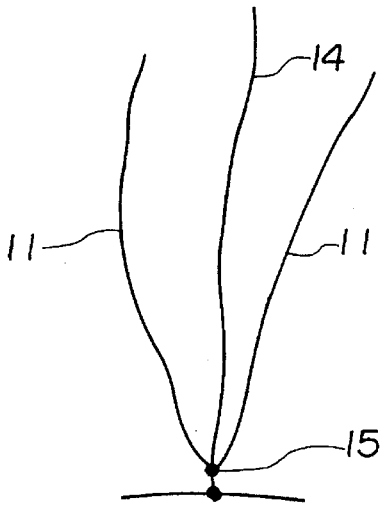
FIG. 9(A) is a schematic view showing the state of fastening one false hair to the natural hair.
Figure 9B:
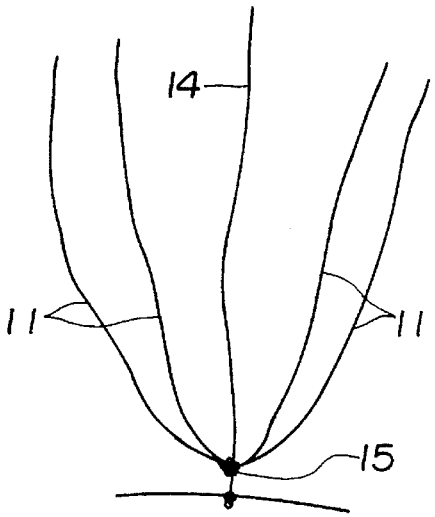
FIG. 9(B) is a schematic view showing the state of fastening two false hairs to the natural hair.

Although one false hair is tied to one natural hair in the foregoing embodiment, two or more false hairs may be fastened in the same manner as above. When two false hairs are tied to one natural hair, the hair on the head can be increased five times. That is, as shown in FIG. 9(A), when one false hair 11 is tied to one natural hair 14 at the prescribed position 15 near the scalp in the foregoing manner, the hair is increased three times. When two false hairs are tied, the hair on the head multiplies five times, as shown in FIG. 9(B).

Thus, it is a matter of course that the hair on the head is increased with increasing the number of the false hairs fastened to the respective natural hairs, but it is necessary to fasten a plurality of false hairs to the natural hair so as not to cause the natural hair on the head to fall off due to excessive hair-increasing. In view of this fact, it is desirable to use a false hair weaker in strength than the natural hair so that, if the worst should happen, e.g. when the hair is washed or combed, the false hair is cut prior to falling off or cutting of the natural hair on the head.

Although the doubled false hair is wound once around the guide rod 2 to form the preliminary knot 13 in the foregoing embodiment as illustrated in FIG. 3, the doubled false hair may be wound two or more times to make the knot more steady.

Figure 10:
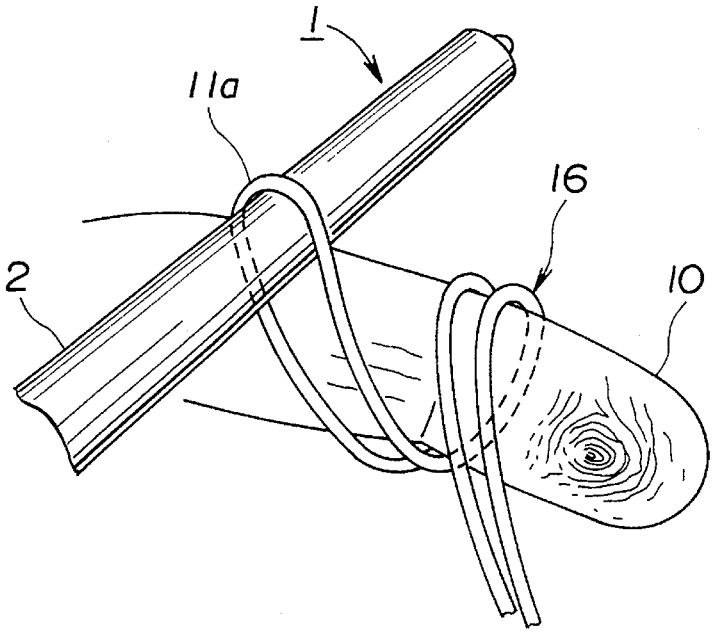
FIG. 10 is an explanatory view showing another embodiment in which the false hair is tied in a modified manner.
Figure 11:
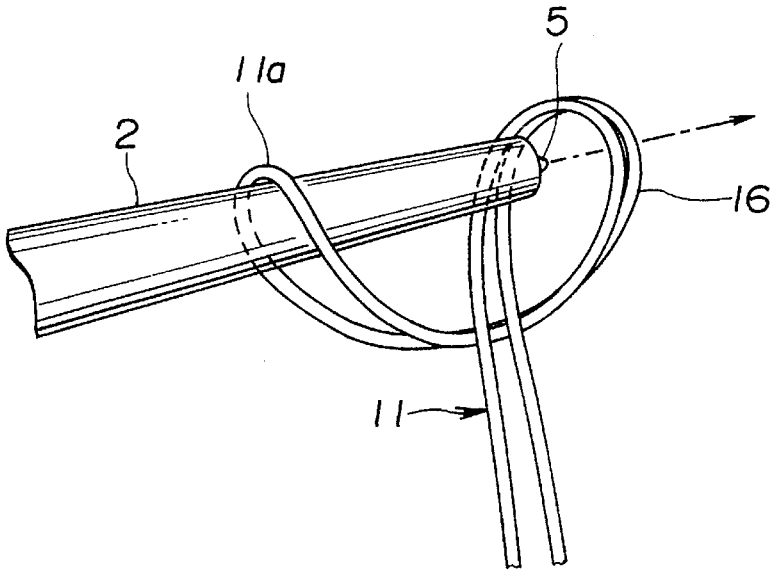
FIG. 11 is an explanatory view showing the succeeding step of FIG. 10, in which the false hair is wound around the hair-increasing device of this invention.
Figure 12:
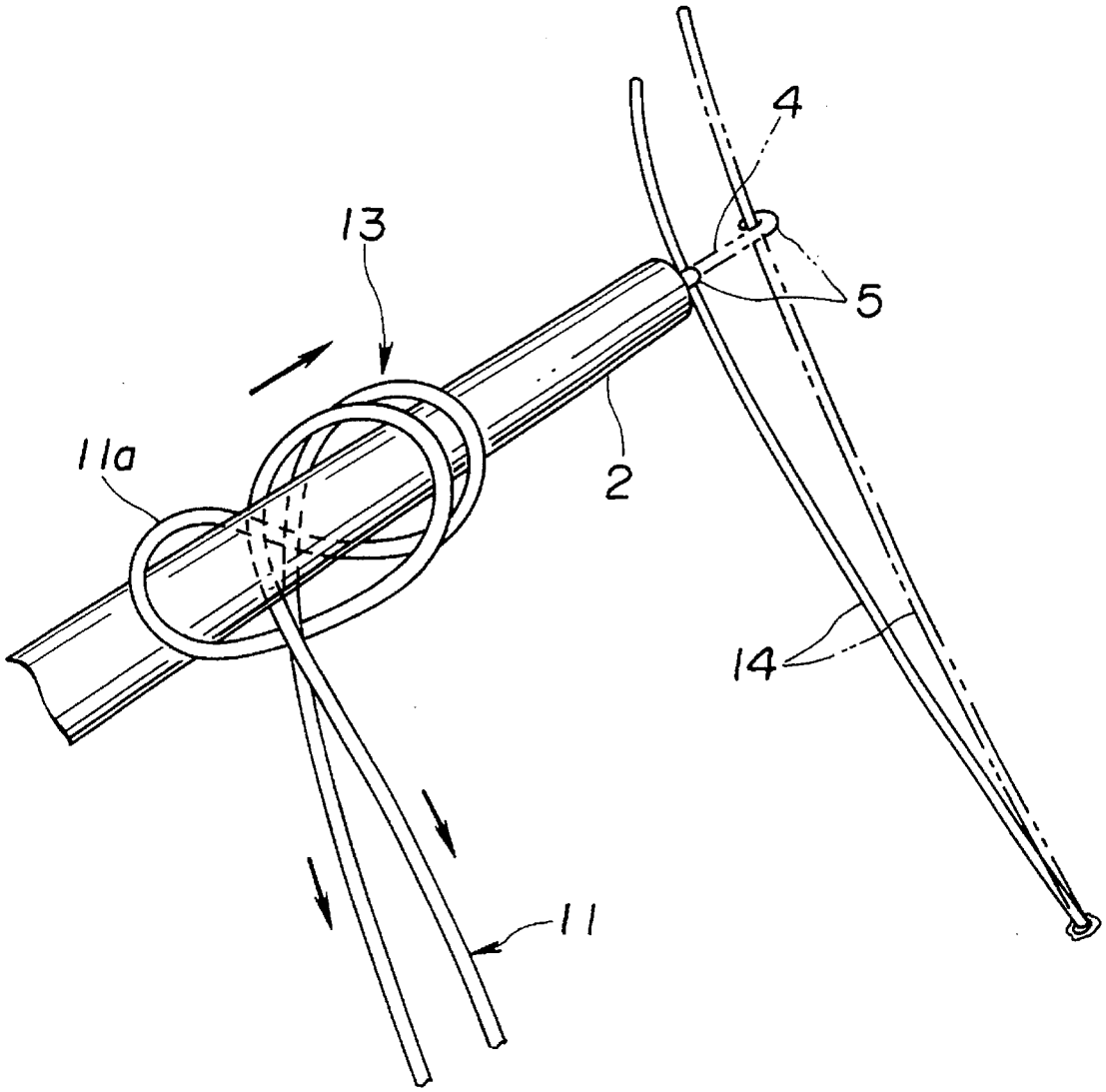
FIG. 12 is an explanatory view showing the state in which the natural hair is held by the device of FIG. 11.

FIGS. 10 to 12 show another embodiment of tying the false hair into a preliminary knot 13 in a modified manner. In this embodiment, the false hair is first bent at the middle portion (bent portion 11*a*) by the guide rod 2, and the loop-forming portions arranged side by side are wound around the finger 10 to form a loop 16 as shown in FIG. 10. Then, the loop 16 is slipped on the tip end portion 9 of the guide rod 2 while maintaining the loop 16 by twisting the loop-forming portions of the false hair 11 as shown in FIG. 11. Consequently, a preliminary knot 13 is formed as shown in FIG. 12.

The preliminary knot 13 of the false hair 11 is slid in the direction of the arrow in FIG. 12 to be transferred from the guide rod 2 to the natural hair 14, while holding the natural hair 14 with the catch member 5 by operating the slide pin 4. Then, the preliminary knot 13 arriving at the prescribed position is tightened in the same manner as described above. As a result, the false hair 11 is firmly fastened to the natural hair to increase the hair on the head.

Although, in the embodiments described above, the catch member 5 retractable into the guide rod is formed in a hook shape by bending the leading end of the slide rod 4, it may be of any shape insofar as it can hold the natural hair. For example, the catch member may be formed of a pair of pincers which is opened when protruded from the tip end of the guide rod 2 and closed when retracted. Thus, the shape of the catch member 5 should not be understood as limiting.

Also, the foregoing embodiments are applied to increase hair on the human head, but this invention is of course useful for a wig, hairpiece or other artificial or natural hair structures including furs.

As is apparent from the foregoing description, according to the present invention, hair on the head can effectively be increased with a simple operation of tying artificial or false hairs to natural hairs on the head by using a device comprising a slide pin with a retractable catch member. That is, the false hair is firmly fastened to the natural hair by being first doubled and wound around the slide pin to form a preliminary knot, transferring the preliminary knot to the prescribed position of the natural hair on the head while steadily holding the natural hair with the retractable catch member of the slide pin, and tightening up the preliminary knot, Furthermore, according to this invention, the false hair is inextricably fixed to the natural hair because the knot is made by windings of three or more turns of the false hair in such a state that the false hair is intricately wound around the natural hair. Therefore, the false hair fastened to the natural hair according to this invention can endure burdens created by washing or combing the hair or other possible daily activities.

As can be readily appreciated, it is possible to deviate from the above embodiments of the present invention and, as will be readily understood by those skilled in this art, the invention is capable of many modifications and improvements within the scope and spirit thereof. Accordingly, it will be understood that the invention is not to be limited by these specific embodiments, but only by the scope and spirit of the appended claims.

What is claimed is:

1. A hair-increasing method for fastening a false hair to a natural hair, said method comprising:

winding said false hair around a guide rod having a slide pin provided at its leading end with a catch member to form a preliminary knot of the false hair around said guide rod;

holding said natural hair with said catch member to thus connect said natural hair with said guide rod;

transferring said preliminary knot along said guide rod and from said guide rod to said natural hair; and pulling both said false hair and said natural hair with a finger, while holding said natural hair with said guide rod so as to tension said natural hair, and thereby tightening said knot in said false hair onto said natural hair.

2. A hair-increasing method for fastening a false hair to a natural hair by use of a hair-increasing device comprising a hollow guide rod having a tip end and a slide pin slidably inserted in said hollow guide rod and provided with a catch member retractable into said tip end of said guide rod, said method comprising:

bending said false hair to have a substantially U-shaped bent portion and loop-forming portions arranged side-by-side;

winding said loop-forming portions of said false hair around said guide rod toward said tip end thereof;

slipping said bent portion on said tip of said guide rod over said loop-forming portions wound around said guide rod to form a preliminary knot around said guide rod;

holding said natural hair with said slide pin;

transferring said preliminary knot from said guide rod to a desired position of said natural hair; and pulling both said false hair and said natural hair to tighten said knot in said false hair.

3. A hair-increasing method for fastening at least one false hair to a natural hair by use of a hair-increasing device comprising a hollow guide rod having a tip end and a slide pin slidably inserted in said guide rod and provided with a catch member retractable into said tip end of said guide rod, said method comprising:

bending said false hair to have a substantially U-shaped bent portion and loop-forming portions arranged side-by-side;

winding said loop-forming portions of said false hair around said guide rod to form a preliminary knot around said guide rod;

holding said natural hair with said slide pin;

transferring said preliminary knot from said guide rod to a position near a root of said natural hair while holding said natural hair with said guide rod and pulling said natural hair with said guide rod; and pulling said false hair in a direction opposite to that in which said natural hair is pulled with said guide rod to tighten said knot of said false hair around said natural hair.

4. A hair-increasing method according to claim 3, wherein two or more of said false hairs are fastened to said natural hair.

5. A hair-increasing method for fastening a false hair to a natural hair by use of a hair-increasing device comprising a hollow guide rod having a tip end and a slide pin slidably inserted in said hollow guide rod and provided with a catch member retractable into the tip end of said guide rod, said method comprising:

bending said false hair to have a substantially U-shaped bent portion and loop-forming portions arranged side-by-side;

winding said loop-forming portions of said false hair around said guide rod toward said tip end thereof;

slipping said bent portion on said tip of said guide rod over said loop-forming portions wound around said guide rod to form a preliminary knot around said guide rod;

holding said natural hair with said catch member to connect said natural hair with said guide rod;

transferring said preliminary knot of said false hair from said guide rod to a position close by a root of said natural hair while holding said natural hair with said guide rod and pulling said natural hair with said guide rod; and pulling said false hair and said natural hair in opposite directions to tighten said knot of said false hair around said natural hair.

* * * * *